US012096851B2

(12) United States Patent
Yao

(10) Patent No.: US 12,096,851 B2
(45) Date of Patent: Sep. 24, 2024

(54) SHELF DEVICE AND STORAGE CABINET

(71) Applicants: HEFEI MIDEA REFRIGERATOR CO., LTD., Anhui (CN); HEFEI HUALING CO., LTD., Anhui (CN); MIDEA GROUP CO., LTD., Guangdong (CN)

(72) Inventor: Nanfei Yao, Anhui (CN)

(73) Assignees: HEFEI MIDEA REFRIGERATOR CO., LTD., Anhui (CN); HEFEI HUALING CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 74 days.

(21) Appl. No.: 17/912,833

(22) PCT Filed: Dec. 21, 2020

(86) PCT No.: PCT/CN2020/138026
§ 371 (c)(1),
(2) Date: Sep. 19, 2022

(87) PCT Pub. No.: WO2021/184867
PCT Pub. Date: Sep. 23, 2021

(65) Prior Publication Data

US 2023/0142165 A1 May 11, 2023

(30) Foreign Application Priority Data

Mar. 18, 2020 (CN) ..... 202010192553.7

(51) Int. Cl.
*A47B 57/06* (2006.01)
*A47B 77/02* (2006.01)
(Continued)

(52) U.S. Cl.
CPC ..... *A47B 57/06* (2013.01); *A47B 77/02* (2013.01); *A47F 3/004* (2013.01); *F25D 25/024* (2013.01)

(58) Field of Classification Search
CPC ..... A47B 57/06; A47B 77/02; A47F 3/004; F25D 25/024
See application file for complete search history.

(56) References Cited

U.S. PATENT DOCUMENTS 765,347 A 7/1904 Vogel
1,920,825 A * 8/1933 Williams ..... B41D 5/00 211/1.57
(Continued)

FOREIGN PATENT DOCUMENTS

CN 101774465 A 7/2010
CN 101915041 A 12/2010
(Continued)

*Primary Examiner* — James O Hansen
(74) *Attorney, Agent, or Firm* — Seed IP Law Group LLP

(57) ABSTRACT

A shelf device and a storage cabinet. The shelf device comprises a shelf body (100); a support frame, the support frame comprising a lead screw (102) and a connecting support (104), the lead screw (102) being fixedly connected to the connecting support (104); a driving assembly, the driving assembly is connected to the shelf body (100), the driving assembly comprising a driving member (106) and a threaded sleeve (108), the driving member (106) being in power coupling connection with the threaded sleeve (108), and the threaded sleeve (108) being in threaded connection with the lead screw (102). The shelf device only needs to be provided with a lead screw (102), and multiple threaded sleeves (108) are sleeved thereon, and then the multiple threaded sleeves (108) are respectively connected to different shelf bodies (100), so that independent adjustment of the multiple shelf bodies (100) can be achieved.

20 Claims, 4 Drawing Sheets

(51) Int. Cl.
*A47F 3/00* (2006.01)
*F25D 25/02* (2006.01)

(56) References Cited

U.S. PATENT DOCUMENTS

| | | | | |
|---|---|---|---|---|
| 2,182,003 | A | 12/1939 | Roark | |
| 2,813,635 | A | 11/1957 | Schumacher | |
| 2,836,305 | A | 5/1958 | Davey et al. | |
| 2,841,459 | A | 7/1958 | Sharpe | |
| 2,861,695 | A | 11/1958 | Carbary | |
| 2,990,068 | A | 6/1961 | Topel | |
| 3,033,636 | A | 5/1962 | Wurtz et al. | |
| 3,337,283 | A * | 8/1967 | Schlenkert | F25D 25/02 312/351 |
| 3,982,801 | A * | 9/1976 | Heidorn | A47B 57/06 62/132 |
| 4,151,804 | A * | 5/1979 | Wache | B66F 7/0608 108/147 |
| 7,178,890 | B2 * | 2/2007 | Park | F25D 25/02 312/408 |
| 8,485,618 | B2 * | 7/2013 | Benz | F24C 15/16 312/408 |
| 8,529,001 | B2 * | 9/2013 | Calvillo | F25D 25/02 312/408 |
| 2012/0298605 | A1 | 11/2012 | Dovner | |
| 2018/0259246 | A1 | 9/2018 | Choi et al. | |

FOREIGN PATENT DOCUMENTS

| | | | |
|---|---|---|---|
| CN | 102207124 | A | 10/2011 |
| CN | 202811768 | U | 3/2013 |
| CN | 203464887 | U | 3/2014 |
| CN | 104930806 | A | 9/2015 |
| CN | 106568291 | A | 4/2017 |
| CN | 106595211 | A | 4/2017 |
| CN | 106642961 | A | 5/2017 |
| CN | 206600978 | U | 10/2017 |
| CN | 207519836 | U | 6/2018 |
| CN | 108634634 | A | 10/2018 |
| CN | 109539682 | A | 3/2019 |
| CN | 109695990 | A | 4/2019 |
| CN | 208951114 | U | 6/2019 |
| CN | 209228836 | U | 8/2019 |
| CN | 209354525 | U | 9/2019 |
| CN | 209838886 | U | 12/2019 |
| CN | 111481001 | A | 8/2020 |
| FR | 1340768 | A | 10/1963 |
| KR | 2003-0091110 | A | 12/2003 |
| WO | WO 2020018052 | A2 | 1/2020 |
| WO | WO 2020045991 | A1 | 3/2020 |
| WO | WO 2020046235 | A2 | 3/2020 |

* cited by examiner

SHELF DEVICE AND STORAGE CABINET

CROSS-REFERENCE TO RELATED APPLICATION

The present application claims priority to Chinese Application No. 202010192553.7, filed on Mar. 18, 2020, entitled "Shelf Device and Storage Cabinet", which is hereby incorporated by reference in its entity.

TECHNICAL FIELD

The present application relates to the technical field of storage apparatus, and in particular, to a shelf device and a storage cabinet.

BACKGROUND

At present, in order to adapt to items with different specifications, some high-end refrigerators are provided with lifting racks to adjust the height of shelves. However, in order to realize the independent adjustment of each shelf, the inner wall of the refrigerator needs to be provided with a set of lifting racks for each shelf, which not only increases the cost, but also creates a high installation difficulty in limited space of the refrigerator and affects the aesthetics. In addition, a set of driving devices is required to be provided for each set of lifting racks. Fixing the driving devices in the refrigerator will occupy the internal space of the refrigerator.

SUMMARY

An objective of the present application is to solve at least one of the problems existing in the related art. Therefore, the present application provides a shelf device, which has a simplified structure and can reduce the space occupied by a driving assembly.

The present application further provides a storage cabinet.

In a first aspect, the shelf device according to an embodiment of the present application includes:

a shelf body;

a support rack including a lead screw and a connecting bracket, the lead screw being fixedly connected with the connecting bracket; and a driving assembly connected with the shelf body, the driving assembly including a driving component and a threaded sleeve, the driving component being dynamically coupled with the threaded sleeve, the threaded sleeve being threadedly connected with the lead screw.

According to the shelf device of an embodiment of the present application, only one set of lead screws is required to realize independent adjustment of a plurality of shelf bodies, which not only saves costs, but also facilitates mounting, and provides good-looking and concise appearance. Moreover, whether the shelf body is in a moving state or a fixed state, it is threadedly connected to the lead screw through the threaded sleeve. Therefore, the shelf body will not slide down because of load bearing or self-weight under the joint constraint of an external thread of the lead screw and an internal thread of the threaded sleeve, which meets the load-bearing demand of the shelf body. In addition, the mounting space of the driving assembly can be saved because the driving assembly is connected to the shelf body.

According to an embodiment of the present application, the shelf device further includes:

a mounting rack provided with a bearing assembly, and the threaded sleeve being pivotally mounted on the mounting rack through the bearing assembly.

According to an embodiment of the present application, the mounting rack includes a first mounting rack and a second mounting rack;

a side of the first mounting rack facing the second mounting rack is provided with a first mounting groove;

a side of the second mounting rack facing the first mounting rack is provided with a second mounting groove; and the bearing assembly includes:

a first bearing provided in the first mounting groove; and a second bearing provided in the second mounting groove.

According to an embodiment of the present application, a peripheral surface of a first end of the threaded sleeve is provided with a first shaft shoulder abutting against an end surface of an inner ring of the first bearing, and the first bearing is clamped with the first shaft shoulder and a groove bottom of the first mounting groove; and a peripheral surface of a second end of the threaded sleeve is provided with a second shaft shoulder abutting against an end face of an inner ring of the second bearing, and the second bearing is clamped with the second shaft shoulder and a groove bottom of the second mounting groove clamp.

According to an embodiment of the present application, the groove bottom of the first mounting groove is provided with a first through hole, a first end of the threaded sleeve is provided to pass the first bearing and the first through hole, the groove bottom of the first mounting groove is provided with a first sinking groove passing through or corresponding to the first through hole, and the first sinking groove is used for oil storage; and the groove bottom of the second mounting groove is provided with a second through hole, a second end of the threaded sleeve is provided to pass the second bearing and the second through hole, the groove bottom of the second mounting groove is provided with a second sinking groove passing through or corresponding to the second through hole, and the second sinking groove is used for oil storage.

According to an embodiment of the present application, the mounting rack further includes:

a third mounting rack provided between the first mounting rack and the second mounting rack; and a step surface provided along an outer edge of the second mounting rack and matched to a shape of the third mounting rack.

According to an embodiment of the present application, an avoidance hole matched to the threaded sleeve is provided on the third mounting rack, and a boss abutting against an end surface of an outer ring of the second bearing is provided along a circumferential direction of the avoidance hole.

According to an embodiment of the present application, an inner hole of the threaded sleeve includes a thread segment and a smooth hole segment, and the diameter of the thread segment is smaller than or equal to the diameter of the smooth hole segment.

According to an embodiment of the present application, the shelf device further includes:

a gear set dynamically coupled with the driving component and the threaded sleeve respectively; and an external gear engaged with the gear set and provided on the threaded sleeve.

According to an embodiment of the present application, the gear set has a transmission stage greater than or equal to two.

According to an embodiment of the present application, there is a plurality of the shelf bodies, and each shelf body is connected to the lead screw through a matched driving assembly.

In a second aspect, the storage cabinet according to an embodiment of the present application, includes a cabinet body and the above-mentioned shelf device, and the shelf device is provided in the cabinet body.

According to an embodiment of the present application, the storage cabinet is a refrigerator, a kitchen cabinet, or a display cabinet.

The above-mentioned one or more solutions in the embodiments of the present application have at least one of the following effects.

According to the shelf device provided by the embodiment of the present application in the first aspect, the lead screw is fixed because the lead screw is fixedly connected with the connecting bracket. A threaded sleeve is sleeved on the lead screw, and the threaded sleeve is connected with the shelf body. Therefore, it is only necessary to provide a set of lead screws, sleeve a plurality of threaded sleeves on it, and connect the plurality of threaded sleeves with different shelf bodies respectively. Independent adjustment of the plurality of shelf bodies can be realized without providing a plurality of sets of lead screws, which not only saves the cost, but also facilitates mounting, and provides good-looking and concise appearance. Moreover, whether the shelf body is in a moving state or a fixed state, it is threadedly connected to the lead screw through the threaded sleeve. Therefore, the shelf body will not slide down because of load bearing or self-weight under the joint constraint of an external thread of the lead screw and an internal thread of the threaded sleeve, which meets the load-bearing demand of the shelf body. In addition, the mounting space of the driving assembly can be saved because the driving assembly is connected to the shelf body.

According to the storage cabinet provided by the embodiment of the present application in the second aspect, by providing the above-mentioned shelf device inside the storage cabinet, the space occupied by the shelf device can be reduced, and the space utilization rate inside the storage cabinet can be improved.

In addition to the problems solved by the present application described above, the features of the constituted solutions, and the advantages brought by the features of these solutions, other features of the present application and the advantages brought by these features will be further described in conjunction with the drawings.

BRIEF DESCRIPTION OF DRAWINGS

To more clearly illustrate the embodiments of the present application or prior art, drawings used in the description of the embodiments or the prior art will be briefly introduced below. The drawings in the following description are only some embodiments of the present application. For those of ordinary skill in the art, other drawings may also be obtained according to these drawings without creative effort.

REFERENCE NUMERALS

Figure 1:
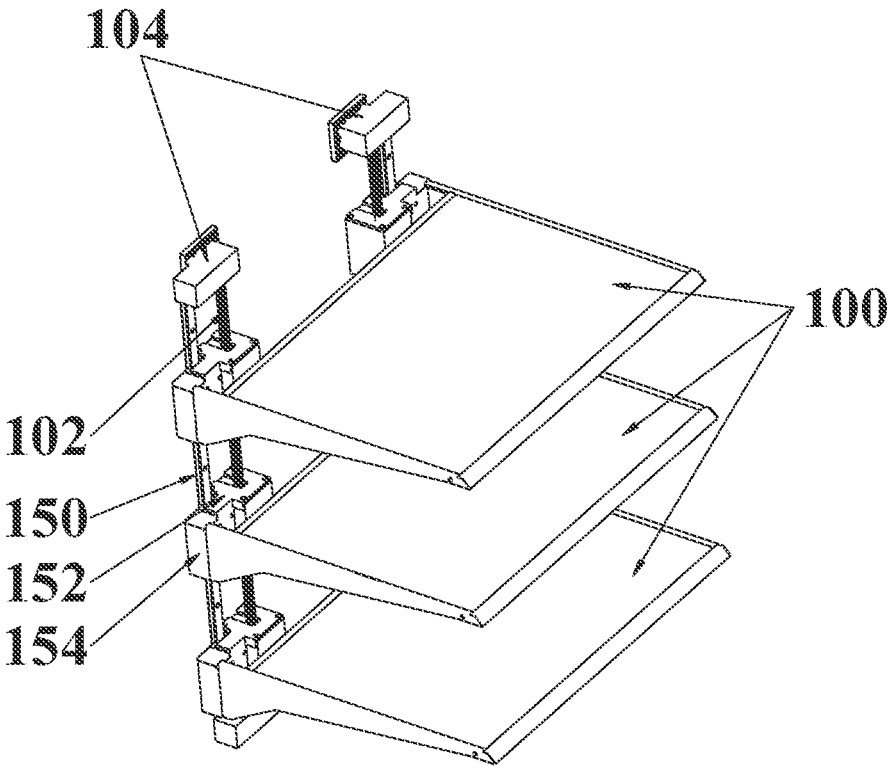
FIG. 1 is a schematic structural diagram of a shelf device provided by an embodiment of the present application.
Figure 2:
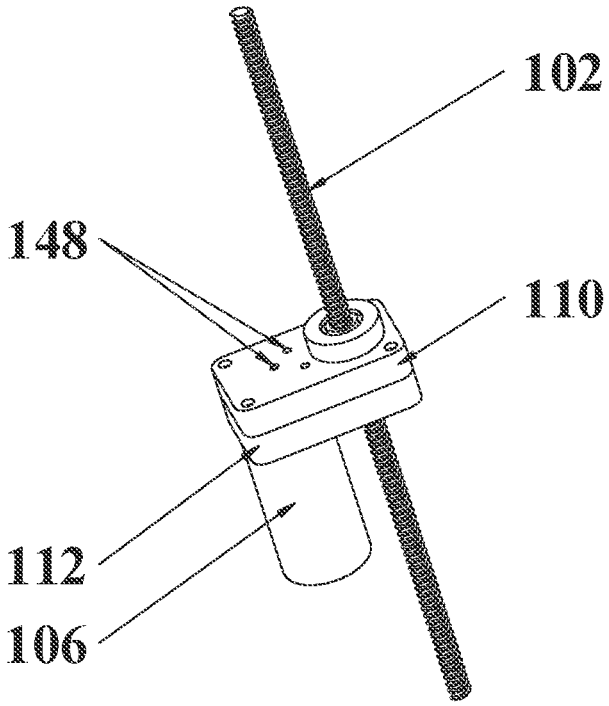
FIG. 2 is a schematic structural diagram of mounting a driving assembly and a lead screw provided by an embodiment of the present application.

100: shelf body; 102: lead screw; 104: connecting bracket; 106: driving component; 108: threaded sleeve; 110: first mounting rack; 112: second mounting rack; 114: first mounting groove; 116: second mounting groove; 118: first bearing; 120: second bearing; 122: first shaft shoulder; 124: second shaft shoulder; 126: first sinking groove; 128: second sink groove; 130: third mounting rack; 132: step surface; 134: avoidance hole; 136: boss; 138: threaded segment; 140: smooth hole segment; 142: gear set; 144: external gear; 146: mounting column; 148: mounting hole; 150: guide rod; 152: connecting plate; 154: sliding block.

DETAILED DESCRIPTION OF THE EMBODIMENTS

The embodiments of the present application will be described in further detail below with reference to the drawings and embodiments. The following embodiments are intended to illustrate the present application, but not to limit the scope of the present application.

In the description of the present application, it is to be noted that, the orientation or positional relations specified by terms such as "central", "longitudinal", "transverse", "upper", "lower", "front", "back", "left", "right", "vertical", "horizontal", "top", "bottom", "inner", "outer" and the like, are based on the orientation or positional relations shown in the drawings, which is merely for convenience of description of the present application and to simplify description, but does not indicate or imply that the stated devices or components must have the particular orientation and be constructed and operated in a particular orientation, and thus it is not to be construed as limiting the present application. Furthermore, the terms "first", "second", "third" and the like are only used for descriptive purposes and should not be construed as indicating or implying a relative importance.

In the description of the present application, it is to be noted that unless explicitly specified and defined otherwise, the terms "connected to" and "connected" shall be understood broadly, for example, it may be either fixedly connected or detachably connected, or can be integrated; it may be either mechanically connected, or electrically connected; it may be either directly connected, or indirectly connected through an intermediate medium. The specific meanings of the terms above in the present application can be understood by a person skilled in the art in accordance with specific conditions.

In the embodiments of the present application, unless otherwise expressly specified and defined, a first feature is "on" or "under" a second feature can refer to that the first feature is directly contacted with the second feature, or the first feature is indirectly contacted with the second feature through an intermediate medium. And further, the first feature is "on", "above" and "over" the second feature can refer to that the first feature is directly above or obliquely above the second feature, or simply refer to that the level height of the first feature is higher than that of the second feature. The first feature is "under", "below" and "beneath" the second feature can refer to that the first feature is directly below or obliquely below the second feature, or simply refer to that the level height of the first feature is lower than that of the second feature.

In the description of this specification, description with reference to the terms "one embodiment", "some embodiments", "an example", "specific example", "some examples" and the like, refers to that specific features, structures, materials, or characteristics described in combination with an embodiment or an example are included in at least one embodiment or example according to the embodiments of the present application. In this specification, schematic representations of the above terms are not necessarily directed to a same embodiment or example. Furthermore, the particular features, structures, materials or characteristics described can be combined in any suitable manner in any one or more embodiments or examples. In addition, those skilled in the art may combine the different embodiments or examples described in this specification, as well as the features of the different embodiments or examples, without conflicting each other.

As shown in FIG. 1 to FIG. 5, an embodiment of the present application provides a shelf device, which includes: a shelf body 100; a support rack, including a lead screw 102 and a connection bracket 104, and the lead screw 102 is fixedly connected with the connecting bracket 104; a driving assembly connected with the shelf body 100, the driving assembly includes a driving component 106 and a threaded sleeve 108, the driving component 106 is dynamically coupled with the threaded sleeve 108, and the threaded sleeve 108 is threadedly connected with the lead screw 102.

According to the shelf device of the embodiment of the present application, the lead screw 102 is fixed because the lead screw 102 is fixedly connected with the connecting bracket 104. A threaded sleeve 108 is sleeved on the lead screw 102, and the threaded sleeve 108 is connected with the shelf body 100. Therefore, it is only necessary to provide a set of lead screws 102, sleeve a plurality of threaded sleeves 108 on it, and connect the plurality of threaded sleeves 108 with different shelf bodies 100 respectively. Independent adjustment of the plurality of shelf bodies 100 can be realized without providing a plurality of sets of lead screws 102, which not only saves the cost, but also facilitates mounting, and provides good-looking and concise appearance. Moreover, whether the shelf body 100 is in a moving state or a fixed state, it is threadedly connected to the lead screw 102 through the threaded sleeve 108. Therefore, the shelf body 100 will not slide down because of load bearing or self-weight under the joint constraint of an external thread of the lead screw 102 and an internal thread of the threaded sleeve 108, which meets the load-bearing demand of the shelf body 100. In addition, the mounting space of the driving assembly can be saved because the driving assembly is connected to the shelf body 100. Since the threaded sleeve 108 and the lead screw 102 are connected in threaded matching, when an item is placed on the shelf body 100, the usage requirement for load-bearing can be met through the self-locking function of the threaded matching.

Specifically, the shelf device provided by an embodiment of the present application will be described below through applying the shelf device provided by an embodiment of the present application to a refrigerator.

The shelf body 100 is used to bearing items, such as items that need to be refrigerated.

The support rack includes a lead screw 102 and a connecting bracket 104. The lead screw 102 is provided vertically, and two ends of the lead screw 102 are fixedly connected to the connecting bracket 104. The connecting bracket 104 can be fixed on an inner wall of a box of the refrigerator.

The lead screw 102 can be a common lead screw or a rolling ball lead screw.

The driving assembly is detachably connected to the shelf body 100, and the function of the driving assembly is to drive the shelf body 100 to move along the length direction of the lead screw 102. The driving assembly includes a driving component 106 and a threaded sleeve 108. The driving component 106 can be a motor, preferably a stepping motor. The stepping motor has advantages of high control accuracy, no accumulative error and the like. The threaded sleeve 108 is sleeved on the lead screw 102 and is threadedly connected with the lead screw 102. Meanwhile, the threaded sleeve 108 is further dynamically coupled with the driving component 106. In this way, when the driving component 106 is activated, it can be transmitted with the threaded sleeve 108, and the threaded sleeve 108 can rotate along the axis of the lead screw 102, thereby forming a displacement along the lead screw 102. As mentioned above, since the driving assembly is mounted on the shelf body 100, the movement of the threaded sleeve 108 can drive the shelf body 100 to move synchronously relative to the lead screw 102, thereby realizing the lifting and lowering of the shelf body 100.

It can be seen that, in an embodiment of the present application, by providing only one or a pair of lead screws 102, providing a plurality of threaded sleeves 108 and a driving component 106 on the lead screw 102, and providing a shelf body 100 corresponding to each threaded sleeve 108 and driving component 106, independent adjustment of the plurality of shelf bodies 100 can be realized without providing a plurality of sets of lead screws 102. Moreover, since the driving component 106 operates synchronously with the shelf body 100, there is no need to additionally provide a space in the box of the refrigerator for accommodating the driving component 106, thereby effectively saving the usage space inside the refrigerator.

As shown in FIG. 2 to FIG. 5, the shelf device provided by the embodiment of the present application further includes a mounting rack. The mounting rack is provided with a bearing assembly, and the threaded sleeve 108 is pivotally mounted on the mounting rack through the bearing assembly.

The mounting rack is configured to mount the driving assembly. The bearing assembly is provided in the mounting rack, and the threaded sleeve 108 is sleeved on the bearing assembly, thereby realizing the smooth rotation of the threaded sleeve 108, improving the rotation efficiency of the threaded sleeve 108, and reducing the friction loss during the rotation of the sleeve 108, and reducing the noise when the threaded sleeve 108 rotates and the threaded sleeve 108 engages with the leas screw 102 for transmission.

Specifically, the mounting rack in an embodiment of the present application includes a first mounting rack 110 and a second mounting rack 112; the bearing assembly includes a first bearing 118 and a second bearing 120.

Figure 3:
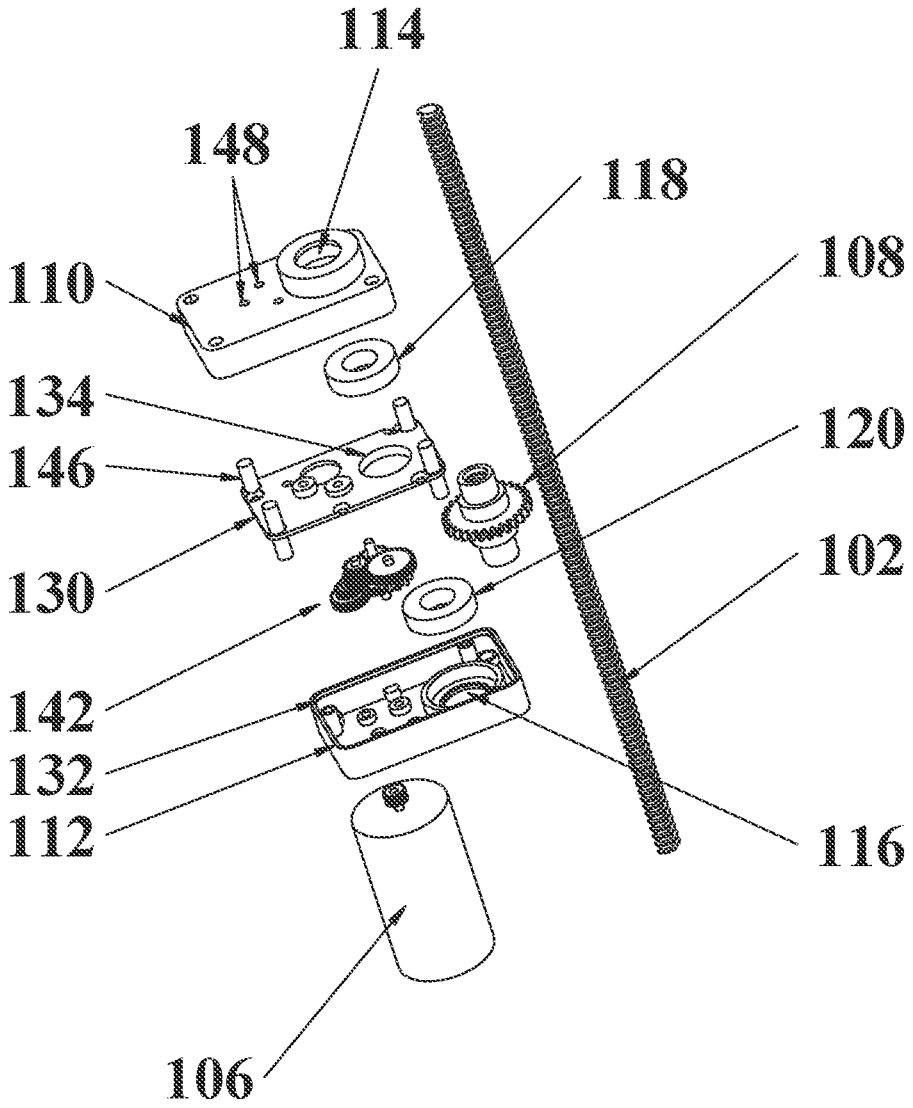
FIG. 3 is a schematic exploded view of mounting a driving assembly and a lead screw provided by an embodiment of the present application.
Figure 4:
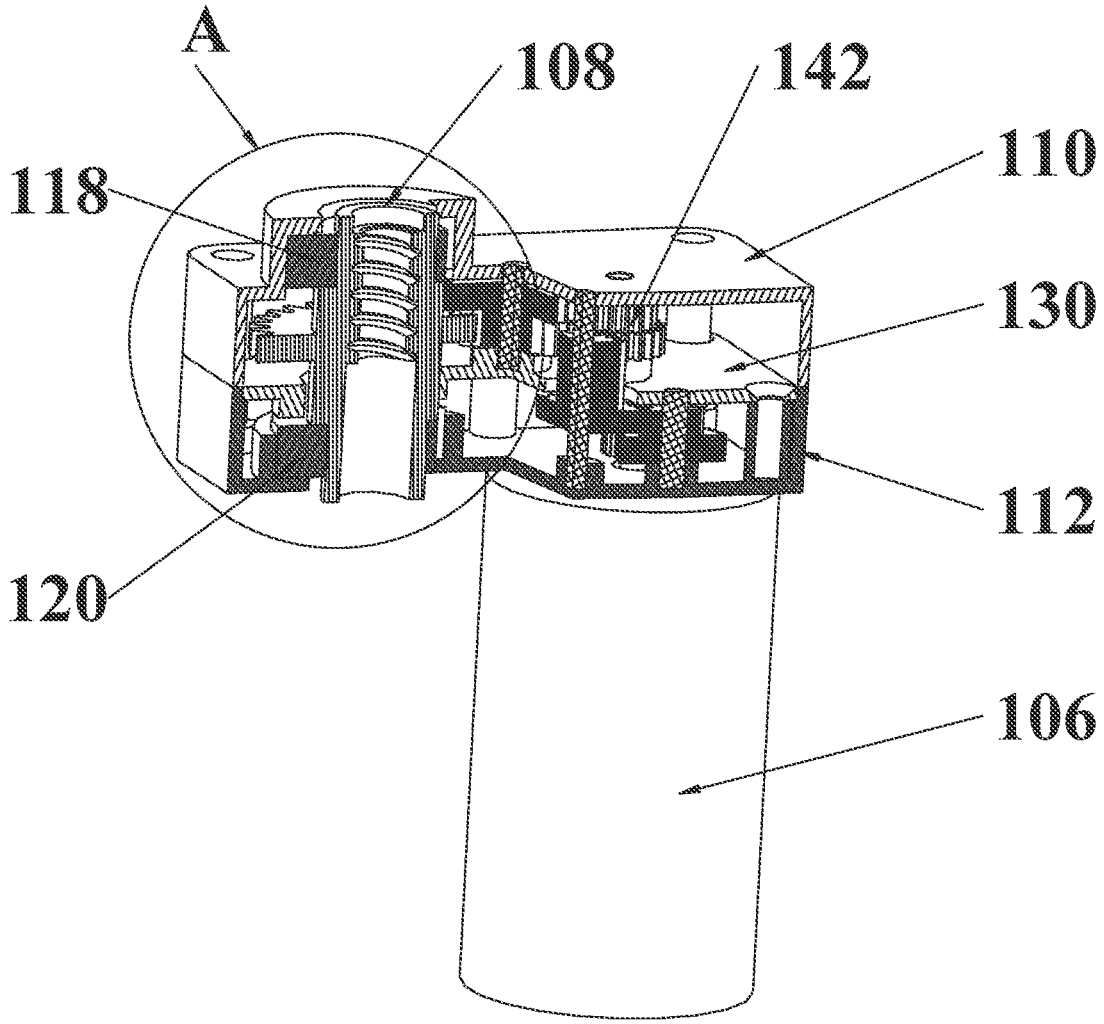
FIG. 4 is a schematic cross-sectional view of a driving assembly provided by an embodiment of the present application.

The first mounting rack 110 specifically refers to the upper mounting rack as shown in FIG. 3; the second mounting rack 112 specifically refers to the lower mounting rack as shown in FIG. 3. A side of the first mounting rack 110 facing the second mounting rack 112 is provided with a first mounting groove 114, and a side of the second mounting rack 112 facing the first mounting rack 110 is provided with a second mounting groove 116; the first bearing 118 is provided in the first mounting groove 114, and the second bearing 120 is provided in the second mounting groove 116.

Referring to FIG. 3, the first mounting rack 110 and the second mounting rack 112 are substantially rectangular open structures, and the first mounting rack 110 and the second mounting rack 112 are buckled with each other to roughly form a cuboid structure.

The shapes of the first mounting groove 114 and the second mounting groove 116 are matched to the shapes of the first bearing 118 and the second bearing 120 respectively. In an embodiment of the present application, the first mounting groove 114 may be formed by an upper surface of the first mounting rack 110 protruding upward, and an opening direction of the first mounting groove 114 is toward the second mounting rack 112; the second mounting groove 116 may be formed by a lower surface of the second mounting rack 112 protruding upward, and an opening direction of the second mounting groove 116 is toward the first mounting rack 110. Moreover, an inner diameter of the first mounting groove 114 may be slightly smaller than or equal to an outer diameter of an outer ring of the first bearing 118, so that the clamping of the first bearing 118 can be better achieved by interference fit. Similarly, an inner diameter of the second mounting groove 116 may be set to be slightly smaller than or equal to an outer diameter of an outer ring of the second bearing 120.

In addition, by providing the first mounting groove 114 and the second mounting groove 116 on the first mounting rack 110 and the second mounting rack 112 respectively, axial positioning of the first bearing 118 and the second bearing 120 can be respectively achieved by a groove bottom of the first mounting groove 114 and a groove bottom of the second mounting groove 116. That is, the groove bottom of the first mounting groove 114 prevents the first bearing 120 from moving upward, and the groove bottom of the second mounting groove 116 prevents the second bearing 120 from moving downward.

The objective of providing the bearing is to reduce the friction force during the threaded sleeve 108 rotates, thereby reducing the noise when the threaded sleeve 108 rotates. Therefore, two ends of the threaded sleeve 108 are provided to pass the inner ring of the first bearing 118 and an inner ring of the second bearing 120 respectively. In this way, when the threaded sleeve 108 rotates, the above-mentioned objective can be achieved through the action of the first bearing 118 and the second bearing 120.

Figure 5:
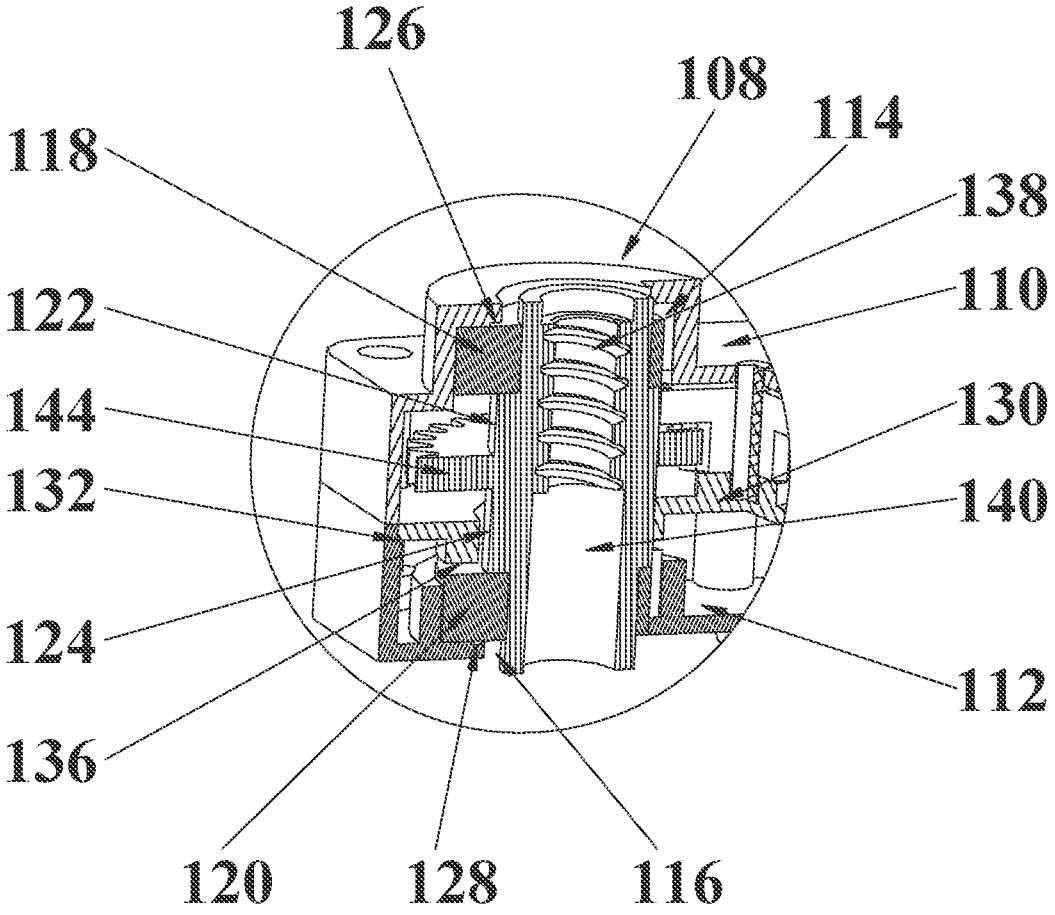
FIG. 5 is an enlarged view of part A in FIG. 4.

Referring to FIG. 5, a peripheral surface of a first end of the threaded sleeve 108 is provided with a first shaft shoulder 122 abutting against an end surface of an inner ring of the first bearing 118, and the first bearing 118 is clamped with the first shaft shoulder 122 and a groove bottom of the first mounting groove 114; a peripheral surface of a second end of the threaded sleeve 108 is provided with a second shaft shoulder 124 abutting against an end face of an inner ring of the second bearing 120, and the second bearing 120 is clamped with the second shaft shoulder 124 and a groove bottom of the second mounting groove 116.

As mentioned above, the groove bottom of the first mounting groove 114 prevents the first bearing 118 from moving upward, and the groove bottom of the second mounting groove 116 prevents the second bearing 120 from moving downward. In order to further preventing the first bearing 118 and the second bearing 120 from moving in a mutually approaching direction, the first end and the second end of the threaded sleeve 108 are respectively provided with the first shaft shoulder 122 and the second shaft shoulder 124. The first end of the threaded sleeve 108 specifically refers to an upper end of the threaded sleeve 108 shown in FIG. 5, and a lower end of the threaded sleeve 108 specifically refers to the lower end of the threaded sleeve 108 shown in FIG. 5.

Moreover, an outer diameter of the first shaft shoulder 122 is larger than the diameter of an inner ring of the first bearing 118, an outer diameter of the second shaft shoulder 124 is larger than the diameter of an inner ring of the second bearing 120, and the outer diameter of the first shaft shoulder 122 may be set to be equal with the outer diameter of the second shaft shoulder 124. In this way, the first shaft shoulder 122 matches with the groove bottom of the first mounting groove 114 to realize axial limiting of the first bearing 118; the second shaft shoulder 124 matches with the groove bottom of the second mounting groove 116 to realize axial limiting of the second bearing 120. When the threaded sleeve 108 rotates, the first bearing 118 and the second bearing 120 will not move axially, which ensures the rotation accuracy of the threaded sleeve 108.

Referring to FIG. 3 and FIG. 5, since the threaded sleeve 108 is sleeved on the lead screw 102, the lead screw 102 also passes through the first mounting rack 110 and the second mounting rack 112 in sequence. In order to achieve the above objection, the first mounting groove 114 is provided with a first through hole, the groove bottom of the second mounting groove 116 is provided with a second through hole. A first end of the threaded sleeve is provided to pass the first bearing 118 and the first through hole, a second end of the threaded sleeve 108 is provided to pass the second bearing 120 and the second through hole.

Further, the diameter of the first through hole may be slightly smaller than the diameter of an outer ring of the first bearing 118, and the diameter of the second through hole may be slightly smaller than the diameter of an outer ring of the second bearing 120. In this way, the clamping of the first bearing 118 and the second bearing 120 can be better achieved.

Still further, the groove bottom of the first mounting groove 114 is provided with a first sinking groove 126 passing through or corresponding to the first through hole; the groove bottom of the second mounting groove 116 is provided with a second sinking groove 128 passing through or corresponding to the second through hole. The first sinking groove 126 and the second sinking groove 128 are used for oil storage.

As shown in FIG. 5, the first sinking groove 126 may be a sinking structure formed on an outer edge of the first through hole, and the second sinking groove 128 may be a sinking structure formed on an outer edge of the second through hole. By providing the first sinking groove 126 and the second sinking groove 128, it can be ensured that a certain amount of lubricating oil is stored in the first sinking groove 126 and the second sinking groove 128, which improves stability and flexibility during the rotation of the first bearing 118 and the second bearing 120.

Referring to FIG. 3, the mounting rack further includes a third mounting rack 130 provided between the first mounting rack 110 and the second mounting rack 112.

In order to ensure the successful installation of the third mounting rack 130 with the first mounting rack 110 and the second mounting rack 112, the outer contour shape of the third mounting rack 130 can be set to be adaptable with the first mounting rack 110 and the second mounting rack 112.

As shown in FIG. 3, the third mounting rack 130 can be a platy structure. In addition, upper and lower surfaces of the third mounting rack 130 are further provided with a mounting column 146 matched with the first mounting rack 110 and the second mounting rack, and the mounting column 146 is provided with a threaded hole. Open holes can be opened on the first mounting rack 110 and the second mounting rack 112 at the positions corresponding to the mounting column 146. Then the first mounting rack 110 and the second mounting rack 112 are respectively connectedly fixed to the third mounting rack 130 through fasteners such as screws.

Further, in order to ensure stable connection between the third mounting rack 130 and the second mounting rack 112, a step surface 132 is provided along an outer edge of the second mounting rack 112 and is matched to a shape of the third mounting rack 130. That is, the third mounting rack 130 can be set on the step surface 132.

Further referring to FIG. 3 and FIG. 5, the third mounting rack 130 is further provided with an avoidance hole 134 matched to the threaded sleeve 108, and a boss 136 abutting against an end surface of the outer ring the second bearing 120 is provided along a circumferential direction of the avoidance hole 134.

In this way, the boss 136 provided along the circumferential direction of the avoidance hole 134 matches with the second shaft shoulders 124 on the above-mentioned threaded sleeves 108, which can further clamp the second bearing 120 in the second mounting groove 116, and prevent the second bearing 120 from moving axially.

As shown in FIG. 5, an inner hole of the threaded sleeve 108 includes a thread segment 138 and a smooth hole segment 140, and the diameter of the thread segment 138 is smaller than or equal to the diameter of the smooth hole segment 140.

The objective of this arrangement is that when mounting the threaded sleeve 108, the smooth hole segment 140 is first mounted on the lead screw 102, and then the thread segment 138 is mounted on the lead screw 102, which more easily realizes the assembly of the threaded sleeve 108 and the lead screw 102. In addition, a certain amount of lubricating oil can further be stored in the smooth hole segment 140 to ensure the flexibility of the rotation of the threaded sleeve 108. Moreover, this can also facilitate the processing of the threaded sleeve 108, that is, it is only required to process a certain length of the thread segment 138 in the inner hole of the threaded sleeve 108. In some other embodiments, only the threaded segment 138 may be provided. In addition, it should be noted that the length of the thread segment 138 should not be set too short, to avoid shaking of the threaded sleeve 108 when the thread segment 138 engages with the lead screw 102 for transmission.

Referring to FIG. 3 and FIG. 5, the shelf device further includes a gear set 142 dynamically coupled with the driving component 106 and the threaded sleeve 108 respectively; an external gear 144 engaged with the gear set 142 and provided on the threaded sleeve 108; and the gear set 142 has a transmission stage greater than or equal to two.

In an embodiment of the present application, by using the gear set 142 as a transmission assembly, it is ensured that the transmission assembly has the advantages of accurate transmission, high efficiency, compact structure, reliable operation, and long service life. Therefore, in order to realize the dynamically coupled connection between the threaded sleeve 108 and the gear set 142, external gear 144 is provided on an outer peripheral surface of the threaded sleeve 108. The external gear 144 may be of a structure similar to a ring gear.

In addition, the gear set 142 is provided to have a transmission stage greater than or equal to two, which can improve the transmission precision during the transmission of the gear set 142.

Moreover, it should be noted that the gear set 142 is also mounted inside the mounting rack. According to an embodiment of the present application, since the gear set 142 is used as a transmission component, the first mounting rack 110, the second mounting rack 112 and the third mounting rack 130 are further provided with mounting holes 148 for mounting a gear shaft.

In an embodiment of the present application, the number of the shelf body 100 may be one or more.

As shown in FIG. 1, when there is a plurality of shelf bodies 100, each shelf body 100 is connected to the lead screw 102 through a driving assembly matched with the shelf body 100. In this way, only one lead screw 102 is required, and a plurality of shelf bodies 100 are connected to the lead screw 102 through the driving assembly, to realize independent adjustment of a plurality of shelf bodies 100, which greatly simplifies the structure of the shelf device. In addition, since the driving assembly operates synchronously with the shelf body 100, there is no need to provide a space in the box of the refrigerator for placing the driving assembly, which improves the space utilization rate of the refrigerator.

In addition, a guide rod 150 can further be provided on a side of the lead screw 102 to improve the stability of the shelf body 100 during movement. Two ends of the guide rod 150 can also be fixedly connected to an inner wall of the box of the refrigerator through the connecting bracket 104. In addition, the driving assembly can be connected to the guide rod 150 through a connecting plate 152, a sliding block 154 or other structures.

The storage cabinet according to an embodiment of the present application in the second aspect includes a cabinet body and the above-mentioned shelf device. The shelf device is provided in the cabinet body.

By providing the above-mentioned shelf device in its interior, the storage cabinet provided by an embodiment of the present application in the second aspect can reduce the space occupied by the shelf device and improve the space utilization rate inside the storage cabinet. More importantly, by providing the above-mentioned shelf device in the storage cabinet, a plurality of shelf bodies 100 can be mounted on a single lead screw 102. Then only a single lead screw 102 is required, and adjustment of each shelf body 100 can be achieved independently through the matching of the driving assembly and the single lead screw 102, which greatly simplifies the structure of the shelf device.

The storage cabinet in the embodiment of the present application may be, but not limited to, a refrigerator, a kitchen cabinet or a display cabinet. The structure and principle of the shelf device in this embodiment are the same as the structure and principle of the shelf device in the above-mentioned embodiment, and will not be repeated in this embodiment.

The above embodiments are only used to illustrate the present application, but not to limit the present application. Although the present application has been described in detail with reference to the embodiments, those of ordinary skill in the art should understand that various combinations, modifications, or equivalent replacements to the solutions of the present application will not depart from the spirit and scope of the solutions of the present application, and should cover within the scope of the claims of this application.

What is claimed is:

1. A shelf device, comprising:

a shelf body;

a support rack including a lead screw and a connecting bracket, the lead screw being fixedly coupled to the connecting bracket;

a driving assembly coupled to the shelf body, the driving assembly including a driving component and a threaded sleeve, the driving component being dynamically coupled to the threaded sleeve, the threaded sleeve being threadedly coupled to the lead screw; and a mounting rack provided with a bearing assembly, the threaded sleeve being pivotally mounted on the mounting rack through the bearing assembly, wherein:

the mounting rack includes a first mounting rack and a second mounting rack;

a side of the first mounting rack facing the second mounting rack is provided with a first mounting groove;

a side of the second mounting rack facing the first mounting rack is provided with a second mounting groove; and the bearing assembly includes:

a first bearing provided in the first mounting groove; and a second bearing provided in the second mounting groove.

2. The shelf device according to claim 1, wherein a peripheral surface of a first end of the threaded sleeve is provided with a first shaft shoulder abutting against an end surface of an inner ring of the first bearing, and the first bearing is clamped with the first shaft shoulder and a groove bottom of the first mounting groove; and a peripheral surface of a second end of the threaded sleeve is provided with a second shaft shoulder abutting against an end face of an inner ring of the second bearing, and the second bearing is clamped with the second shaft shoulder and a groove bottom of the second mounting groove.

3. The shelf device according to claim 1, wherein the groove bottom of the first mounting groove is provided with a first through hole, a first end of the threaded sleeve is provided to pass the first bearing and the first through hole, the groove bottom of the first mounting groove is provided with a first sinking groove corresponding to the first through hole, and the first sinking groove is used for oil storage; and the groove bottom of the second mounting groove is provided with a second through hole, a second end of the threaded sleeve is provided to pass the second bearing and the second through hole, the groove bottom of the second mounting groove is provided with a second sinking groove corresponding to the second through hole, and the second sinking groove is used for oil storage.

4. The shelf device according to claim 1, wherein the mounting rack further comprises:

a third mounting rack provided between the first mounting rack and the second mounting rack; and a step surface provided along an outer edge of the second mounting rack and matched to a shape of the third mounting rack.

5. The shelf device according to claim 4, wherein an avoidance hole matched to the threaded sleeve is provided on the third mounting rack, and a boss abutting against an end surface of an outer ring of the second bearing is provided along a circumferential direction of the avoidance hole.

6. The shelf device according to claim 1, wherein an inner hole of the threaded sleeve comprises a thread segment and a smooth hole segment, and a diameter of the thread segment is smaller than or equal to a diameter of the smooth hole segment.

7. The shelf device according to claim 1, further comprising:

a gear set dynamically coupled with the driving component and the threaded sleeve respectively; and an external gear engaged with the gear set and provided on the threaded sleeve.

8. The shelf device according to claim 7, wherein the gear set has a transmission stage greater than or equal to two.

9. The shelf device according to claim 1, wherein the shelf body comprises a plurality of the shelf bodies, and each shelf body of the plurality of the shelf bodies is connected to the lead screw through a matched driving assembly.

10. A storage cabinet including a cabinet body and a shelf assembly provided in the cabinet body, the shelf assembly comprising:

a shelf body;

a support rack including a lead screw and a connecting bracket, the lead screw being fixedly coupled to the connecting bracket;

a driving assembly coupled to the shelf body, the driving assembly including a driving component and a threaded sleeve, the driving component being dynamically coupled to the threaded sleeve, the threaded sleeve being threadedly coupled to the lead screw; and a mounting rack provided with a bearing assembly, the threaded sleeve being pivotally mounted on the mounting rack through the bearing assembly, wherein:

the mounting rack includes a first mounting rack and a second mounting rack;

a side of the first mounting rack facing the second mounting rack is provided with a first mounting groove;

a side of the second mounting rack facing the first mounting rack is provided with a second mounting groove; and the bearing assembly includes:

a first bearing provided in the first mounting groove; and a second bearing provided in the second mounting groove.

11. The storage cabinet according to claim 10, wherein the storage cabinet is a refrigerator, a kitchen cabinet, or a display cabinet.

12. The storage cabinet according to claim 10, wherein a peripheral surface of a first end of the threaded sleeve is provided with a first shaft shoulder abutting against an end surface of an inner ring of the first bearing, and the first bearing is clamped with the first shaft shoulder and a groove bottom of the first mounting groove; and a peripheral surface of a second end of the threaded sleeve is provided with a second shaft shoulder abutting against an end face of an inner ring of the second bearing, and the second bearing is clamped with the second shaft shoulder and a groove bottom of the second mounting groove.

13. The storage cabinet according to claim 10, wherein the groove bottom of the first mounting groove is provided with a first through hole, a first end of the threaded sleeve is provided to pass the first bearing and the first through hole, the groove bottom of the first mounting groove is provided with a first sinking groove corresponding to the first through hole, and the first sinking groove is used for oil storage; and the groove bottom of the second mounting groove is provided with a second through hole, a second end of the threaded sleeve is provided to pass the second bearing and the second through hole, the groove bottom of the second mounting groove is provided with a second sinking groove corresponding to the second through hole, and the second sinking groove is used for oil storage.

14. The shelf device according to claim 10, wherein the mounting rack further comprises:

a third mounting rack provided between the first mounting rack and the second mounting rack; and a step surface provided along an outer edge of the second mounting rack and matched to a shape of the third mounting rack.

15. A refrigerator including a cabinet body and a shelf assembly provided in the cabinet body, the shelf assembly comprising:

a shelf body;

a support rack including a lead screw and a connecting bracket, the lead screw being fixedly coupled to the connecting bracket;

a driving assembly coupled to the shelf body, the driving assembly including a driving component and a threaded sleeve, the driving component being dynamically coupled to the threaded sleeve, the threaded sleeve being threadedly coupled to the lead screw; and a mounting rack provided with a bearing assembly, the threaded sleeve being pivotally mounted on the mounting rack through the bearing assembly, wherein:

the mounting rack includes a first mounting rack and a second mounting rack;

a side of the first mounting rack facing the second mounting rack is provided with a first mounting groove;

a side of the second mounting rack facing the first mounting rack is provided with a second mounting groove; and the bearing assembly includes:

a first bearing provided in the first mounting groove; and a second bearing provided in the second mounting groove.

16. The refrigerator according to claim 15, wherein the shelf assembly further comprises:

a gear set dynamically coupled with the driving component and the threaded sleeve respectively; and an external gear engaged with the gear set and provided on the threaded sleeve.

17. The refrigerator according to claim 15, wherein a peripheral surface of a first end of the threaded sleeve is provided with a first shaft shoulder abutting against an end surface of an inner ring of the first bearing, and the first bearing is clamped with the first shaft shoulder and a groove bottom of the first mounting groove; and a peripheral surface of a second end of the threaded sleeve is provided with a second shaft shoulder abutting against an end face of an inner ring of the second bearing, and the second bearing is clamped with the second shaft shoulder and a groove bottom of the second mounting groove.

18. The refrigerator according to claim 17, wherein the groove bottom of the first mounting groove is provided with a first through hole, a first end of the threaded sleeve is provided to pass the first bearing and the first through hole, the groove bottom of the first mounting groove is provided with a first sinking groove corresponding to the first through hole, and the first sinking groove is used for oil storage; and the groove bottom of the second mounting groove is provided with a second through hole, a second end of the threaded sleeve is provided to pass the second bearing and the second through hole, the groove bottom of the second mounting groove is provided with a second sinking groove corresponding to the second through hole, and the second sinking groove is used for oil storage.

19. The refrigerator according to claim 15, wherein the mounting rack further comprises:

a third mounting rack provided between the first mounting rack and the second mounting rack; and a step surface provided along an outer edge of the second mounting rack and matched to a shape of the third mounting rack.

20. The refrigerator according to claim 19, wherein an avoidance hole matched to the threaded sleeve is provided on the third mounting rack, and a boss abutting against an end surface of an outer ring of the second bearing is provided along a circumferential direction of the avoidance hole.

* * * * *